US009990937B1

(12) United States Patent
Tu et al.

(10) Patent No.: US 9,990,937 B1
(45) Date of Patent: Jun. 5, 2018

(54) DEVICE AND METHOD FOR SYNCHRONIZING SPEAKERS

(71) Applicant: Beken Corporation, Shanghai (CN)

(72) Inventors: Wenxing Tu, Shanghai (CN); Xiaoyan He, Shanghai (CN)

(73) Assignee: BEKEN CORPORATION, Shanghai (CN)

( * ) Notice: Subject to any disclaimer, the term of this patent is extended or adjusted under 35 U.S.C. 154(b) by 0 days. days.

(21) Appl. No.: 15/384,312

(22) Filed: Dec. 19, 2016

(30) Foreign Application Priority Data

Dec. 7, 2016 (CN) ..... 2016 1 1117078

(51) Int. Cl.

| | |
|---|---|
| ***H04R 29/00*** | (2006.01) |
| ***G10L 21/043*** | (2013.01) |
| ***H04R 3/12*** | (2006.01) |
| ***H04R 3/04*** | (2006.01) |

(52) U.S. Cl.
CPC ..... *G10L 21/043* (2013.01); *H04R 3/04* (2013.01); *H04R 3/12* (2013.01); *H04R 29/002* (2013.01); *H04R 2420/07* (2013.01)

(58) Field of Classification Search
CPC ..... G10L 21/043; H04R 3/04; H04R 3/12; H04R 29/002
See application file for complete search history.

(56) References Cited

U.S. PATENT DOCUMENTS

2010/0235486 A1* 9/2010 White ..... H04L 43/0858 709/223
2012/0300944 A1* 11/2012 Spittle ..... H04R 3/12 381/17
2017/0277507 A1* 9/2017 Ando ..... G06F 3/165

* cited by examiner

*Primary Examiner* — Simon King
(74) *Attorney, Agent, or Firm* — Perkins Coie LLP

(57) ABSTRACT

A first speaker, comprising: a receiver configured to receive, from a second speaker, a second runtime and a second number of audio samples when the first speaker plays an audio file synchronized with the second speaker; a calculator configured to calculate a time interval value based on the second runtime; a generator configured to generate a revised second number of audio samples based on the time interval value; a comparator configured to compare a difference between the revised second number of audio samples and a first number of audio samples of the first speaker so as to determine the amount of latency of the first speaker; an adjustor configured to adjust a playing speed of the first speaker; and an output configured to output the audio file according to the adjusted playing speed.

11 Claims, 3 Drawing Sheets

DEVICE AND METHOD FOR SYNCHRONIZING SPEAKERS

CROSS REFERENCE TO RELATED APPLICATION

This application claims priority to Chinese application No. 201611117078.7 entitled "Device and method for synchronizing speakers," filed on Dec. 7, 2016 by Beken Corporation, which is incorporated herein by reference.

TECHNICAL FIELD

The present invention relates to synchronization of speakers, and more particularly, but not limited to a device and method for synchronizing speakers in a wireless network.

BACKGROUND

With the development of wireless technology, in some occasions, two conventional speakers, usually a master speaker and a slave speaker, need to be coupled together in a continuous manner by a wireless connection. However, since the two speakers start to play an audio file at different timing and the clocking of the Digital Analog Converters (DACs) of each of the two speakers are not exactly synchronized and the two speakers usually have different packet loss, latency exists between the master and slave speakers, so that the audience may have a relatively poor auditory perspective. Therefore, it may be desirable to provide a device and method to handle the above problems and minimize the possibility of latency between the master and slave speakers.

SUMMARY

An embodiment of the invention discloses a first speaker, comprising a receiver configured to receive, from a second speaker samples, a second runtime and a second number of audio samples when the first speaker plays an audio file synchronized with the second speaker, wherein the audio file is comprised of audio samples; a calculator coupled to the receiver and configured to calculate a time interval value based on the second runtime; a generator coupled to the calculator and configured to generate a revised second number of audio samples based on the time interval value; a comparator coupled to the generator and configured to compare a difference between the revised second number of audio samples and a first number of audio samples of the first speaker so as to determine the amount of latency of the first speaker relative to the second speaker; and an adjustor coupled to the comparator and configured to adjust an playing speed of the first speaker based on the amount of latency; an output coupled to the adjustor and configured to output the audio file according to the adjusted playing speed.

Another embodiment of the invention discloses a method for determining the amount of latency when playing an audio file in a wireless network, comprising receiving, by a first speaker, from a second speaker a second runtime and a second number of audio samples; calculating, by a first speaker, a time interval value based on the second runtime; generating, by a first speaker, a revised second number of audio samples based on the time interval value; comparing, by a first speaker, a difference between the revised second number of audio samples and a first number of audio samples of the first speaker so as to determine the amount of latency of the first speaker relative to the second speaker; and outputting, by the first speaker, the amount of latency to an adjustor so that a playing speed of the first speaker can be adjusted.

Another embodiment of the invention discloses a method for synchronizing speakers in a wireless network, comprising playing, by a first speaker, an audio file comprised of audio samples, synchronized with a second speaker; determining, by the first speaker, the amount of latency when playing the audio file by: receiving, with a receiver, from the second speaker a second runtime and a second number of audio samples, calculating, with a calculator, a time interval value based on the second runtime, generating, with a generator, a revised second number of audio samples based on the time interval value, and comparing, with a comparator, a difference between the revised second number of audio samples and a first number of audio samples of the first speaker so as to determine the amount of latency of the first speaker relative to the second speaker; and adjusting, by the first speaker, a playing speed based on the amount of latency; outputting, by the first speaker, the audio file according to the adjusted playing speed.

DESCRIPTION OF THE DRAWINGS

The present invention is illustrated in an exemplary manner by the accompanying drawings. The drawings should be understood as exemplary rather than limiting, as the scope of the invention is defined by the claims. In the drawings, the identical reference signs represent the same elements.

DETAILED DESCRIPTION

Various aspects and examples of the invention will now be described. The following description provides specific details for a thorough understanding and enabling description of these examples. Those skilled in the art will understand, however, that the invention may be practiced without many of these details. Additionally, some well-known structures or functions may not be shown or described in detail, so as to avoid unnecessarily obscuring the relevant description.

Figure 1:
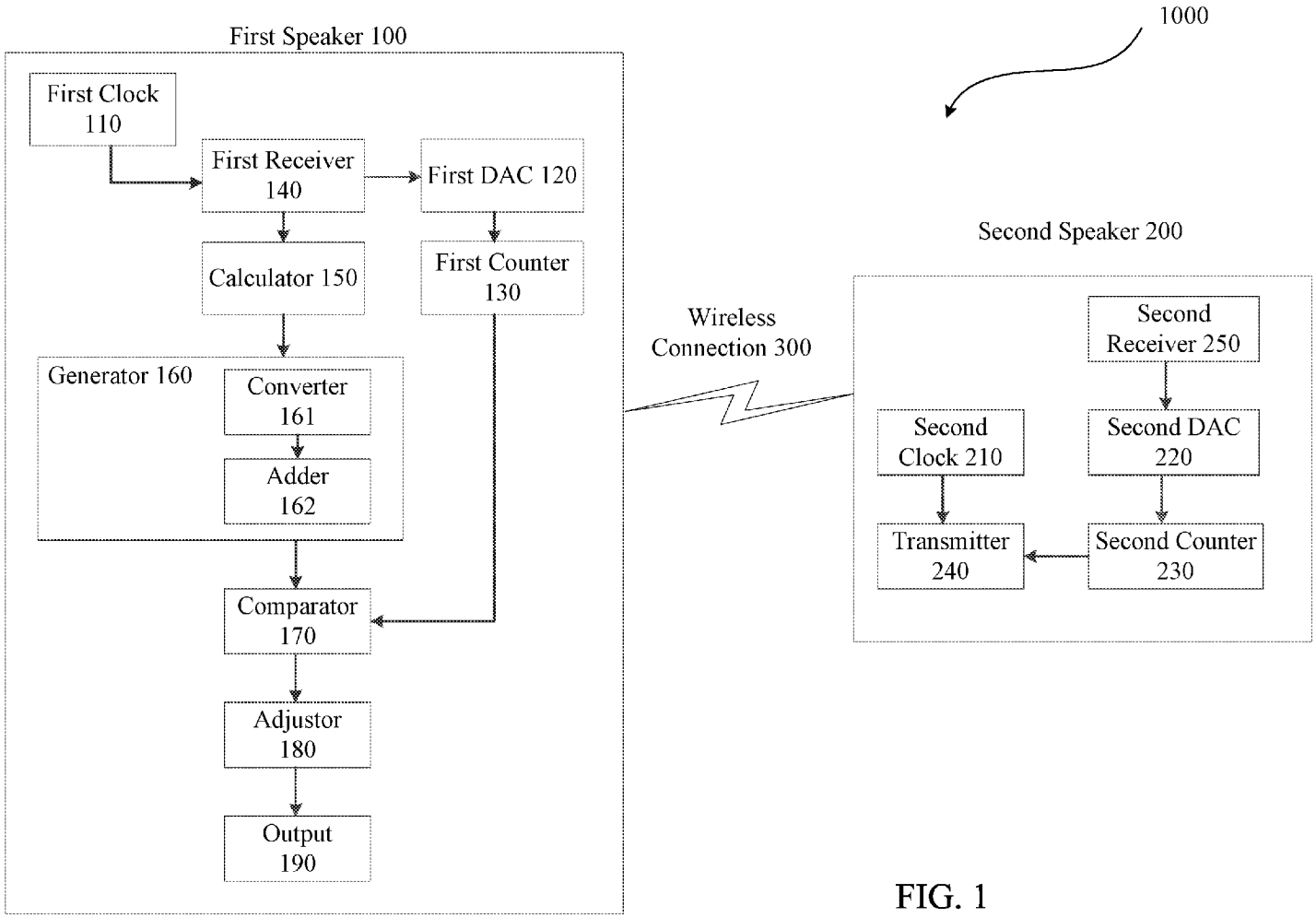
FIG. 1 is a diagram illustrating a system including a first speaker and a second speaker according to an embodiment of the invention.

FIG. 1 is a diagram illustrating a system 1000 including a first speaker 100 and a second speaker 200 according to an embodiment of the invention. As shown in FIG. 1, the first speaker 100 comprises a first DAC 120, a first counter 130 coupled to the first DAC 120, a first receiver 140 coupled to the first DAC 120, a calculator 150 coupled to the first receiver 140, a first clock 110 coupled to the first receiver 140, a generator 160 coupled to the calculator 150, a comparator 170 coupled to the generator 160 and the first counter 130, and an adjustor 180 coupled to the comparator 170, and an output 190 coupled to the adjustor 180. The second speaker 200 comprises a second receiver 250, a second DAC 220 coupled to the second receiver 250, a second counter 230 coupled to the second DAC 220, a transmitter 240 coupled to the second counter 230, and a second clock 210 coupled to the transmitter 240.

In the system shown in FIG. 1, the second speaker 200 is a master speaker, and the first speaker 100 is a slave speaker. The first speaker 100 and the second speaker 200 are in communication with each other by a wireless connection 300. In one embodiment, the wireless connection 300 is a Bluetooth type connection. The second speaker 200 may be coupled to various peripherals (not shown), such as a mobile phone, provided with Bluetooth function. The mobile phone may transmit information including audio data and instructions to the second speaker 200 in order to control it to play or stop playing an audio file. After receiving the information from the mobile phone by the second receiver 250 of the second speaker 200, the second speaker 200 transmits the information to the first speaker 100 via communication protocols. In one embodiment, the second speaker 200 transmits the instructions to the first speaker 100 via Audio/Video Remote Control Profile (AVRCP), and transmits the audio data to the first speaker 100 via Advanced Audio Distribution Profile (A2DP) Channel. In one embodiment, the audio data includes the audio file comprised of audio samples to be played by both the first and the second speakers 100 and 200. After the second speaker 200 transmits the instruction to start playing the audio file, the first speaker 100 plays the audio file synchronized with the second speaker 200.

The first clock 110 is synchronized with the second clock 210 as a system clock. That is, the first clock 110 and the second clock 210 have the same clocking speed and value. After the communication between the first and the second speakers 100 and 200 is established, a first runtime of the first speaker 100 and a second runtime of the second speaker 200 are accumulated by the first and the second clocks 110 and 210 respectively to indicate the duration of the wireless communication between the first and the second speakers 100 and 200.

After the first and the second speakers 100 and 200 start to play the audio file, the first and the second counters 130 and 230 count the number of audio samples outputted by the first and the second DACs 120 and 220 continuously; and then at a second timing, for example, at 1:00, the transmitter 240 of the second speaker 200 sends audio information of the second speaker 200 including the current second runtime, i.e., BT_CLK (master), and the counted second number of audio samples, i.e., AUD_RUN_NUM (master), to the first speaker 100 via a communication protocol. In one embodiment, the communication protocol is AVRCP.

Then at a first timing, for example, at 1:01, the first receiver 140 of the first speaker 100 receives the audio information from the second speaker 200. The first timing is different from the second timing since it takes time to transmit the audio information from the second speaker 200 to the first speaker 100 via wireless connection 300.

Alternatively, the first receiver 140 of the first speaker 100 receives the second runtime BT_CLK(master) and the second number of audio samples AUD_RUN_NUM (master) from the second speaker 200 at a predetermined rate, for example, per 10 seconds, which enables the first speaker 100 to adjust a playing speed in time.

After receiving the audio information from the second speaker 200, still at the first timing, i.e., at 1:01, the calculator 150 of the first speaker 100 calculates a time interval value A BT_CLK by subtracting the second runtime BT_CLK (master) from the first runtime BT_CLK (slave) of the first speaker 100. The first runtime is obtained by the first clock 110 at the first timing.

After that, the generator 160, as shown in FIG. 1, generates a revised second number of audio samples AUD_RUN_NUM (master') based on the time interval value ΔBT_CLK. That is, the first speaker 100 can estimate what the second number of audio samples could be at the first timing.

The generator 160 further comprises a converter 161 and an adder 162. The converter 161 is configured to convert the time interval value ΔBT_CLK into an additional number of audio samples ΔAUD_RUN_NUM (master) based on an audio sample rate, for example, 44.1 kHz. The adder 162 is coupled to the converter 161 and is configured to add the additional number of audio samples ΔAUD_RUN_NUM (master) to the second number of audio samples AUD_RUN_NUM (master) to generate the revised second number of audio samples AUD_RUN_NUM (master').

Then the comparator 170 coupled to the generator 160 compares a difference between the revised second number of audio samples AUD_RUN_NUM (master') and a first number of audio samples AUD_RUN_NUM (slave) of the first speaker 100 so as to determine the amount of latency of the first speaker 100 relative to the second speaker 200. The first number of audio samples AUD_RUN_NUM (slave) is the number of the audio samples accumulated by the first counter 130 of the first speaker 100 at the first timing.

After determining the amount of latency of the first speaker 100, the adjustor 180 coupled to the comparator 170 adjusts a playing speed of the first speaker 100 based on the amount of latency, as will be discussed with further details with respect to FIG. 3.

Finally, the output 190 coupled to the adjustor 180 continues to output the audio file according to the adjusted playing speed.

Figure 2:
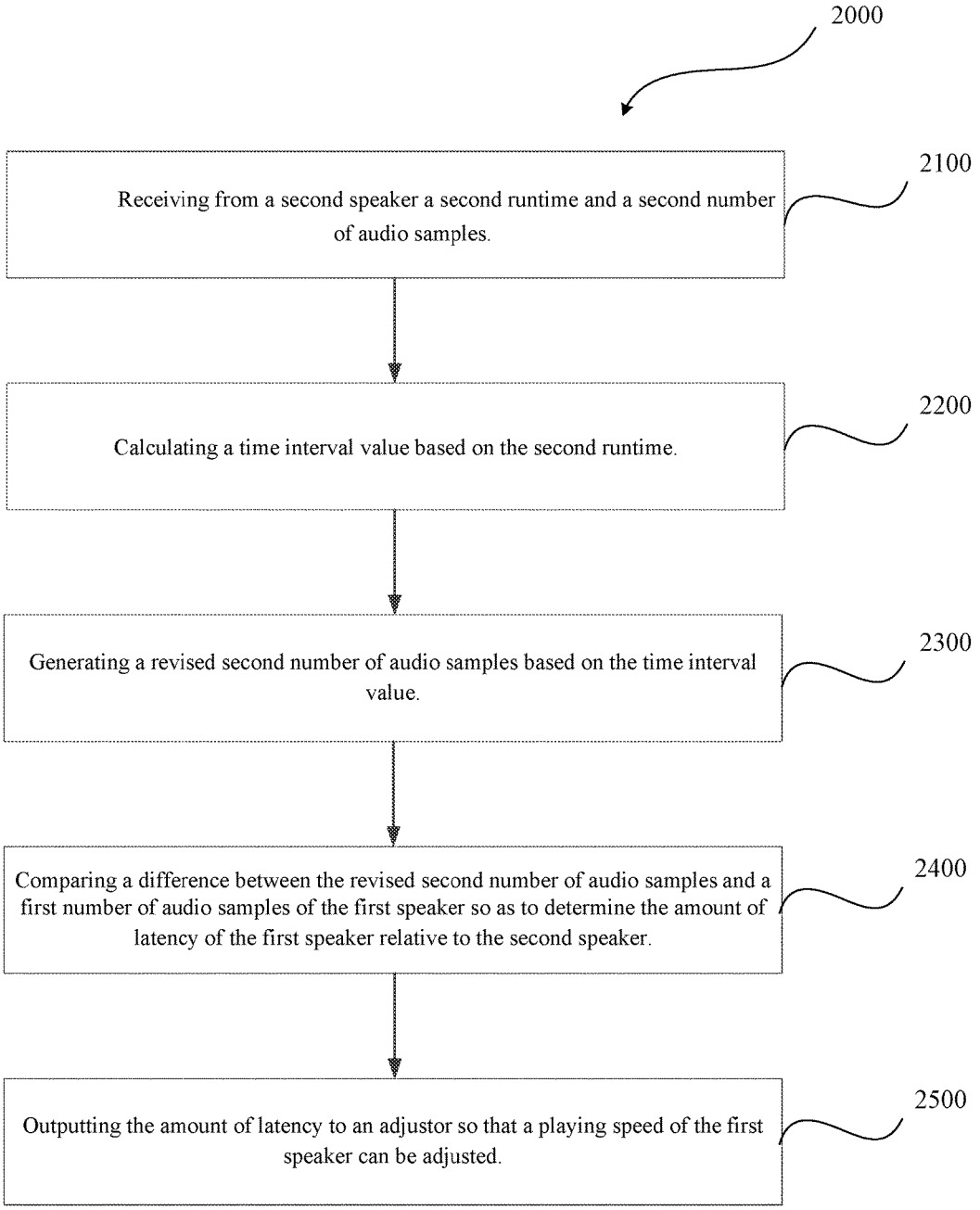
FIG. 2 is a flow chart illustrating a method for determining the amount of latency when playing an audio file in a wireless network according to an embodiment of the invention.

FIG. 2 is a flow chart illustrating a method 2000 for determining the amount of latency when playing an audio file in a wireless network according to an embodiment of the invention.

The method 2000 that enables the first speaker 100 to determine the amount of latency comprises: receiving, in block 2100, from a second speaker 200 a second runtime and a second number of audio samples; calculating, in block 2200, a time interval value based on the second runtime; generating, in block 2300, a revised second number of audio samples based on the time interval value; comparing, in block 2400, a difference between the revised second number of audio samples and a first number of audio samples of the first speaker 100 so as to determine the amount of latency of the first speaker 100 relative to the second speaker 200; and outputting, in block 2300, the amount of latency to an adjustor so that a playing speed of the first speaker 100 can be adjusted.

Alternatively, the method 2000 further comprises the first speaker 100 receives the second runtime and the second number of audio samples from the second speaker 200 at a predetermined rate.

Alternatively, calculating the time interval value comprises subtracting the second runtime from a first runtime of the first speaker 100, and the second runtime is generated by the second speaker 200 at a second timing, at which the second speaker 200 sends the second runtime and the second number of audio samples to the first speaker 100, and the first runtime is generated by the first speaker 100 at a first timing, at which the first speaker 100 receives the second runtime and the second number of audio samples from the second speaker 200.

Alternatively, generating the revised second number of audio samples comprises: converting, with the converter 161, the time interval value into an additional number of audio samples based on an audio sample rate; and adding, with the adder 162, the additional number of audio samples to the second number of audio samples to generate the revised second number of audio samples.

Figure 3:
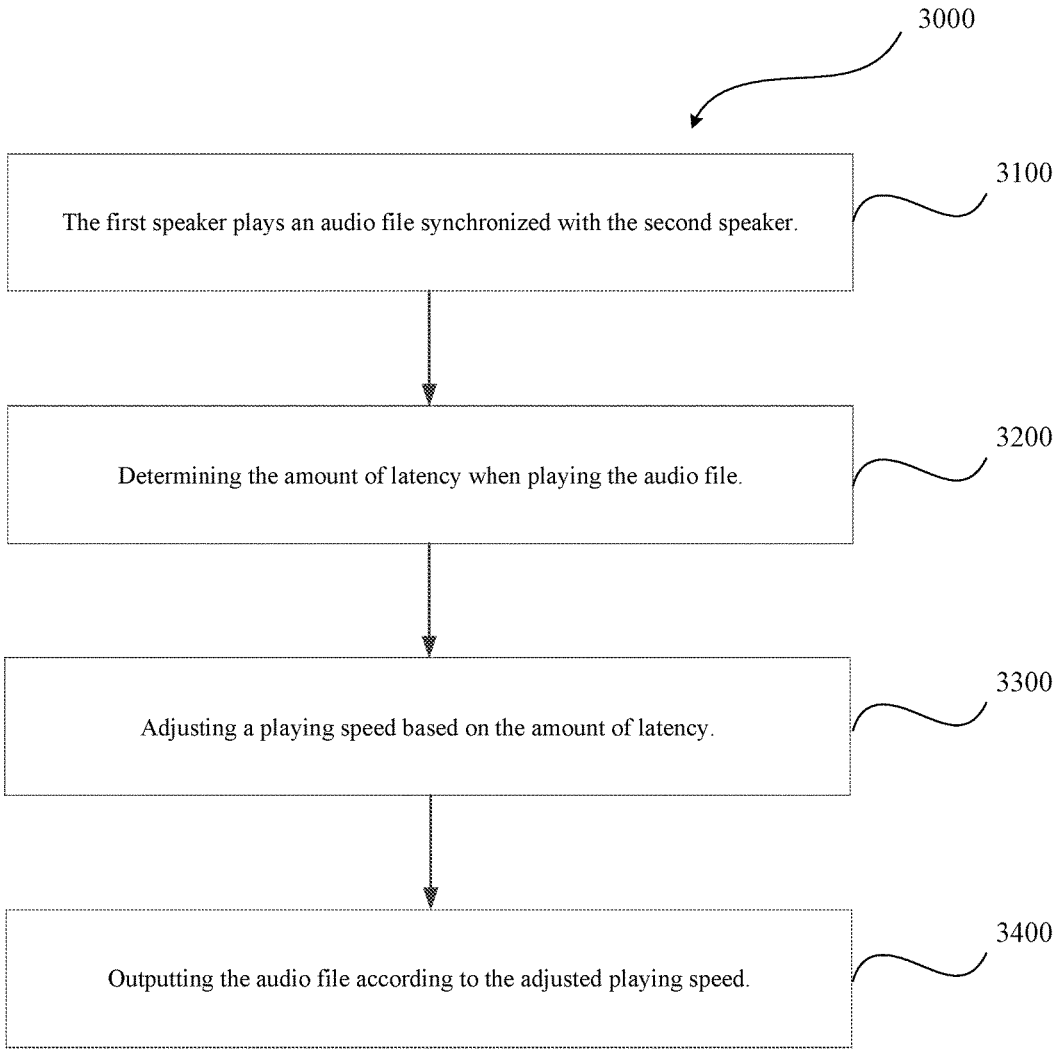
FIG. 3 is a flow chart illustrating a method for synchronizing two speakers in a wireless network according to an embodiment of the invention.

FIG. 3 is a flow chart illustrating a method 3000 for synchronizing two speakers in a wireless network according to an embodiment of the invention.

In block 3100, the first speaker 100 plays an audio file synchronized with a second speaker 200. The audio file is comprised of audio samples. The first speaker 100 and the second speaker 200 are in communication with each other via a wireless protocol, such as Bluetooth. Once the communication is established, the clocks of the two speakers are synchronized and accumulated at the same time. The precision is about 312.5 us.

In block 3200, the first speaker 100 determines the amount of latency when playing the audio file by: receiving, with a first receiver 140, from the second speaker 200 a second runtime and a second number of audio samples; calculating, with a calculator 150, a time interval value based on the second runtime, generating, with a generator 160, a revised second number of audio samples based on the time interval value, and comparing, with a comparator 170, a difference between the revised second number of audio samples and a first number of audio samples of the first speaker 100 so as to determine the amount of latency of the first speaker 100 relative to the second speaker 200. Please note the amount of latency may be expressed as the number of audio samples or expressed in time which can be converted from the number of audio samples based on the audio sample rate.

In block 3300, the first speaker 100 adjusts a playing speed based on the amount of latency.

In block 3400, the first speaker 100 continues to output the audio file according to the adjusted playing speed.

Alternatively, the method 3000 further comprises the first speaker 100 receives custom data from the second speaker 200 to decide a timing to play the audio file before starting to play the audio file. That is, the second speaker 200 transmits the custom data to the first speaker 100 via a communication protocol. In one embodiment, the communication protocol is AVRCP. Before the predetermined timing, the two speakers only transmit audio data including the audio file, and do not play the audio file, which enables the two speakers to play the audio file at the same time and further minimize the possibility of latency.

Alternatively, the method 3000 further comprises the first speaker 100 receives the second runtime and the second number of audio samples from the second speaker 200 at a predetermined rate. Every time the speakers start to play a new audio file, the counters will recalculate the number of audio samples.

Alternatively, calculating the time interval value comprises subtracting the second runtime from a first runtime of the first speaker 100, and the second runtime is generated by the second speaker 200 at a second timing, at which the second speaker 200 sends the second runtime and the second number of audio samples to the first speaker 100, and the first runtime is generated by the first speaker 100 at a first timing, at which the first speaker 100 receives the second runtime and the second number of audio samples from the second speaker 200.

Alternatively, generating the revised second number of audio samples comprises: converting, with a converter 161, the time interval value into an additional number of audio samples based on an audio sample rate; and adding, with an adder 162, the additional number of audio samples to the second number of audio samples to generate the revised second number of audio samples.

Alternatively, adjusting the playing speed further comprises: (a) if the amount of latency is less than a first predetermined value, for example, less than 0.5 ms, the first speaker 100 does not adjust the playing speed; (b) if the amount of latency is above the first predetermined value and less than a second predetermined value, for example, greater than 0.5 ms and less than 2 ms, the first speaker 100 adjusts the playing speed by adjusting a clock of a first DAC 120 of the first speaker 100; and (c) if the amount of latency is above the second predetermined value, for example, greater than 2 ms, the first speaker 100 adjusts the playing speed by controlling data stream of the first speaker 100 including deleting an audio package comprised of audio samples and compensating for all-zeros data for audio samples to accomplish a quick adjustment.

Features and aspects of various embodiments may be integrated into other embodiments, and embodiments illustrated in this document may be implemented without all of the features or aspects illustrated or described. One skilled in the art will appreciate that although specific examples and embodiments of the system and methods have been described for purposes of illustration, various modifications can be made without deviating from the spirit and scope of the present invention. Moreover, features of one embodiment may be incorporated into other embodiments, even where those features are not described together in a single embodiment within the present document. Accordingly, the invention is described by the appended claims.

We claim:

1. A first speaker, comprising:

a receiver configured to receive, from a second speaker, a second runtime and a second number of audio samples when the first speaker plays an audio file synchronized with the second speaker, wherein the audio file is comprised of audio samples;

a calculator coupled to the receiver and configured to subtract the second runtime from a first runtime of the first speaker to generate a time interval value, wherein the second runtime is generated by the second speaker at a second timing, at which the second speaker sends the second runtime and the second number of audio samples to the first speaker, and the first runtime is generated by the first speaker at a first timing, at which the first speaker receives the second runtime and the second number of audio samples from the second speaker;

a generator coupled to the calculator and configured to generate a revised second number of audio samples based on the time interval value;

a comparator coupled to the generator and configured to compare a difference between the revised second number of audio samples and a first number of audio samples of the first speaker so as to determine the amount of latency of the first speaker relative to the second speaker;

an adjustor coupled to the comparator and configured to adjust a playing speed of the first speaker based on the amount of latency; and an output coupled to the adjustor and configured to output the audio file according to the adjusted playing speed.

2. The first speaker of claim 1, wherein the receiver receives the second runtime and the second number of audio samples from the second speaker at a predetermined rate.

3. The first speaker of claim 1, wherein the generator further comprises:

a converter configured to convert the time interval value into an additional number of audio samples based on an audio sample rate; and an adder coupled to the converter and configured to add the additional number of audio samples to the second number of audio samples to generate the revised second number of audio samples.

4. A method for determining the amount of latency when playing an audio file in a wireless network, comprising:

receiving, by a first speaker, from a second speaker a second runtime and a second number of audio samples;

calculating, by the first speaker, a time interval value based on the second runtime;

converting, by the first speaker, the time interval value into an additional number of audio samples based on an audio sample rate;

adding, by the first speaker, the additional number of audio samples to the second number of audio samples to generate a revised second number of audio samples;

comparing, by the first speaker, a difference between the revised second number of audio samples and a first number of audio samples of the first speaker so as to determine the amount of latency of the first speaker relative to the second speaker; and outputting, by the first speaker, the amount of latency to an adjustor so that a playing speed of the first speaker can be adjusted.

5. The method of claim 4, wherein the first speaker receives the second runtime and the second number of audio samples from the second speaker at a predetermined rate.

6. The method of claim 4, wherein calculating the time interval value comprises subtracting the second runtime from a first runtime of the first speaker, and the second runtime is generated by the second speaker at a second timing, at which the second speaker sends the second runtime and the second number of audio samples to the first speaker, and the first runtime is generated by the first speaker at a first timing, at which the first speaker receives the second runtime and the second number of audio samples from the second speaker.

7. A method for synchronizing speakers in a wireless network, comprising:

playing, by a first speaker, an audio file comprised of audio samples, synchronized with a second speaker;

determining, by the first speaker, the amount of latency when playing the audio file by:

receiving, with a receiver, from the second speaker a second runtime and a second number of audio samples, calculating, with a calculator, a time interval value based on the second runtime, generating, with a generator, a revised second number of audio samples based on the time interval value, and comparing, with a comparator, a difference between the revised second number of audio samples and a first number of audio samples of the first speaker so as to determine the amount of latency of the first speaker relative to the second speaker; and adjusting, by the first speaker, a playing speed based on the amount of latency, comprising:

(a) if the amount of latency is less than a first predetermined value, the first speaker does not adjust the playing speed, (b) if the amount of latency is above the first predetermined value and less than a second predetermined value, the first speaker adjusts the playing speed by adjusting a clock of a first Digital Analog Converter of the first speaker, and (c) if the amount of latency is above the second predetermined value, the first speaker adjusts the playing speed by controlling data stream of the first speaker; and outputting, by the first speaker, the audio file according to the adjusted playing speed.

8. The method of claim 7, wherein the first speaker receives custom data from the second speaker to decide a timing to play the audio file before starting to play the audio file.

9. The method of claim 7, wherein the first speaker receives the second runtime and the second number of audio samples from the second speaker at a predetermined rate.

10. The method of claim 7, wherein calculating the time interval value comprises subtracting the second runtime from a first runtime of the first speaker, and the second runtime is generated by the second speaker at a second timing, at which the second speaker sends the second runtime and the second number of audio samples to the first speaker, and the first runtime is generated by the first speaker at a first timing, at which the first speaker receives the second runtime and the second number of audio samples from the second speaker.

11. The method of claim 7, wherein generating the revised second number of audio samples comprises:

converting, with a converter, the time interval value into an additional number of audio samples based on an audio sample rate; and adding, with an adder, the additional number of audio samples to the second number of audio samples to generate the revised second number of audio samples.

* * * * *